US012389997B2

(12) United States Patent
Yang

(10) Patent No.: US 12,389,997 B2
(45) Date of Patent: Aug. 19, 2025

(54) CONVENIENT-TO-STIR COSMETIC CONTAINER

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/806,708

(22) Filed: Aug. 16, 2024

(65) Prior Publication Data

US 2025/0151876 A1 May 15, 2025

(30) Foreign Application Priority Data

Nov. 10, 2023 (CN) ..... 202311498123.8

(51) Int. Cl.
*A45D 34/04* (2006.01)
*A45D 40/26* (2006.01)

(52) U.S. Cl.
CPC ..... *A45D 34/048* (2013.01); *A45D 34/045* (2013.01); *A45D 40/265* (2013.01)

(58) Field of Classification Search
CPC .. A45D 34/048; A45D 34/045; A45D 34/046; A45D 40/265; A45D 40/267
USPC ..... 401/4, 121, 122, 126–130
See application file for complete search history.

(56) References Cited

U.S. PATENT DOCUMENTS

| | | | | |
|---|---|---|---|---|
| 4,290,706 | A * | 9/1981 | Wandl | B44D 3/08 401/129 |
| 9,295,316 | B2 * | 3/2016 | Mathiez | A45D 34/048 |
| 10,327,530 | B2 * | 6/2019 | Tarling | A45D 34/045 |

* cited by examiner

*Primary Examiner* — David J Walczak
(74) *Attorney, Agent, or Firm* — Bayramoglu Law Offices LLC

(57) ABSTRACT

A convenient-to-stir cosmetic container includes a lid assembly, a bottle assembly, an applicator assembly, and a stirrer, where the applicator assembly is provided in the lid assembly; the lid assembly can cover the bottle assembly; the bottle assembly is provided therein with an accommodation cavity for storing a cosmetic material; the stirrer is provided in the accommodation cavity; the stirrer can move along an axial direction of the bottle assembly, so as to stir the cosmetic material in the accommodation cavity; and a distance between an outer peripheral wall of the stirrer and an inner peripheral wall of the bottle assembly is L1, and the accommodation cavity has a width of L2, L1≤0.1*L2. In the container, the stirrer has a large size, and the stirrer can move along an axial direction of the container.

9 Claims, 17 Drawing Sheets

CONVENIENT-TO-STIR COSMETIC CONTAINER

CROSS-REFERENCE TO THE RELATED APPLICATIONS

This application is based upon and claims priority to Chinese Patent Application No. 202311498123.8, filed on Nov. 10, 2023, the entire contents of which are incorporated herein by reference.

TECHNICAL FIELD

The present disclosure relates to a cosmetic packaging technology, and in particular to a convenient-to-stir cosmetic container.

BACKGROUND

In order to store and use cosmetics conveniently, cosmetics are usually filled in cosmetic containers. Cosmetics are prone to layer separation in storage. Before use, cosmetic containers need to be shaken, so as to uniformly mix the cosmetics in the containers. For the sake of a better mixing effect, a steel ball is provided in the containers. However, due to the small size of the steel ball, the mixing effect is limitedly improved. Moreover, the steel ball is easily stuck between the brush rod and the bottle body, which is inconvenient for consumers.

SUMMARY

The present disclosure provides a convenient-to-stir cosmetic container, to overcome the above defects. In the container, the stirrer has a large size, and the stirrer can move along an axial direction of the container. The present disclosure not only achieves a desirable stirring effect, but also makes the stirrer not stuck, thereby improving the user satisfaction.

To solve the technical problems, the present disclosure employs the following technical solutions:

A convenient-to-stir cosmetic container includes a lid assembly, a bottle assembly, an applicator assembly, and a stirrer, where the applicator assembly is provided in the lid assembly; the lid assembly can cover the bottle assembly; the bottle assembly is provided therein with an accommodation cavity for storing a cosmetic material; the stirrer is provided in the accommodation cavity; the stirrer can move along an axial direction of the bottle assembly, so as to stir the cosmetic material in the accommodation cavity; and a distance between an outer peripheral wall of the stirrer and an inner peripheral wall of the bottle assembly is L1, and the accommodation cavity has a width of L2, L1≤0.1*L2.

Optionally, the outer peripheral wall of the stirrer is attached to the inner peripheral wall of the bottle assembly.

Optionally, a shape enclosed by the outer peripheral wall of the stirrer is the same as a shape enclosed by the inner peripheral wall of the bottle assembly.

Optionally, the stirrer includes an elastic member made of a metal material.

Optionally, the elastic member includes a first spring that is wavy, and the first spring encloses a sealed annular structure.

Optionally, the first spring includes a plurality of waves; and when the first spring is provided in the bottle assembly, the waves extend along the axial direction of the bottle assembly.

Optionally, the elastic member includes a second spring; and the second spring moves up spirally along the axial direction of the bottle assembly.

Optionally, the elastic member includes a third spring; the third spring extends spirally along a circumferential direction of the bottle assembly; and the third spring encloses a sealed annular structure.

Optionally, the stirrer further includes a weight; the weight is a metal member of an annular structure; and the weight is located at a side of the elastic member away from a bottle bottom of the bottle assembly.

Optionally, orthographic projection of the elastic member on the bottle bottom of the bottle assembly is at least one of a square, an ellipse, and a circle; and orthographic projection of the weight on the bottle bottom of the bottle assembly is at least one of a square, an ellipse, and a circle.

Optionally, the bottle assembly includes a bottle body and an intermediate ring fixedly provided at a neck of the bottle body; the bottle body includes the bottle bottom; the accommodation cavity is formed in the bottle body; the applicator assembly includes a brush rod and a brush head fixedly provided at a tail of the brush rod; and a head of the brush rod is fixedly provided in the lid assembly.

The present disclosure has the following beneficial effects: According to the present disclosure, the stirrer is provided in the cosmetic material of the bottle assembly, with a width basically the same as a width of the accommodation cavity in the bottle assembly. The stirrer is the elastic member or the elastic member and the weight. When the cosmetic container is shaken, the elastic member can move along the axial direction of the bottle assembly, and the elastic member can cause deformations, thereby improving a mixing effect of the cosmetic material. Moreover, the elastic member is not stuck between the brush rod and the bottle assembly for the small size, thereby improving the user satisfaction and the makeup efficiency.

In the figures: 10—lid assembly, 20—bottle assembly, 21—bottle body, 22—intermediate ring, 23—accommodation cavity, 24—bottle bottom, 30—applicator assembly, 31—brush rod, 32—brush head, 33—internal stopper, 40—first spring, 41—highest point, 42—lowest point, 50—second spring, 60—third spring, and 70—weight.

DETAILED DESCRIPTION OF THE EMBODIMENTS

The following describes the technical solutions in the embodiments of the present disclosure clearly and completely with reference to the embodiments of the present disclosure. Apparently, the embodiments described are merely some rather than all of the embodiments of the present disclosure. All other embodiments obtained by a person of ordinary skill in the art based on the embodiments of the present disclosure without creative efforts shall fall within the protection scope of the present disclosure.

It should be noted that the terms "first", "second" and so on in the description and claims of the present disclosure and in the above accompanying drawings are intended to distinguish similar objects but do not necessarily indicate a specific order or sequence. It should be understood that the objects used in such a way may be exchanged under proper conditions to make it possible to implement the described implementations of this application in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment 1

Figure 1:
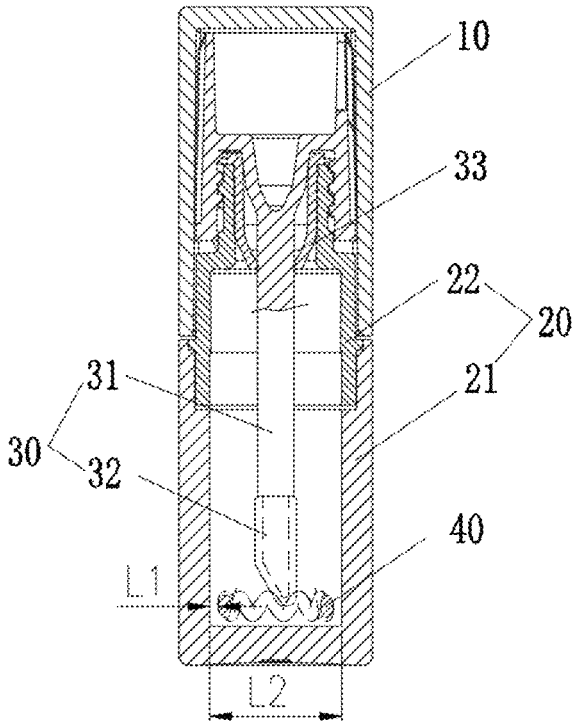
FIG. 1 is a schematic structural view of a cosmetic container according to Embodiment 1 of the present disclosure.

As shown in FIGS. 1-9, a convenient-to-stir cosmetic container includes lid assembly 10, bottle assembly 20, applicator assembly 30, and a stirrer. The applicator assembly 30 is provided in the lid assembly 10. The lid assembly 10 can cover the bottle assembly 20. The bottle assembly 20 is provided therein with accommodation cavity 23 for storing a cosmetic material. The stirrer is provided in the accommodation cavity 23. The stirrer can move along an axial direction of the bottle assembly 20, so as to stir the cosmetic material in the accommodation cavity 23. As shown in FIG. 1, a distance between an outer peripheral wall of the stirrer and an inner peripheral wall of the bottle assembly 20 is L1, and the accommodation cavity 23 has a width of L2, L1≤0.1*L2. Optionally, L1≤0.07*L2.

The width of the accommodation cavity 23 is a minimum size of the accommodation cavity along a radial direction of the bottle assembly 20. For example, in response to a circular radial section of the accommodation cavity 23 along the bottle assembly 20, the width of the accommodation cavity 23 is a diameter of the radial section. In response to a square radial section of the accommodation cavity 23 along the bottle assembly 20, the width of the accommodation cavity 23 is an edge of the radial section. In response to a rectangular radial section of the accommodation cavity 23 along the bottle assembly 20, the width of the accommodation cavity 23 is a width of the radial section. In response to an elliptical radial section of the accommodation cavity 23 along the bottle assembly 20, the width of the accommodation cavity 23 is a minor-axis length of the radial section, etc.

According to the present disclosure, the stirrer is provided in the cosmetic material of the bottle assembly, with a width basically the same as a width of the accommodation cavity in the bottle assembly. When the cosmetic container is shaken, the stirrer can move along the axial direction of the bottle assembly. While uniformly mixing the cosmetic material, the stirrer is not stuck between the brush rod and the bottle assembly for the small size, thereby improving the mixing effect of the cosmetic material, and improving the user satisfaction, makeup effect and makeup efficiency.

Optionally, the outer peripheral wall of the stirrer is contacting the inner peripheral wall of the bottle assembly 20. In this way, when the cosmetic container is shaken, and the stirrer moves along the axial direction of the bottle assembly 20, the stirrer can fully stir the cosmetic material in the bottle assembly 20 to uniformly mix the cosmetic material.

Optionally, a shape enclosed by the outer peripheral wall of the stirrer is the same as a shape enclosed by the inner peripheral wall of the bottle assembly 20. This can ensure that a periphery of the stirrer and a periphery of the bottle assembly 20 are attached completely, thereby further improving the mixing effect of the cosmetic material. Optionally, the stirrer includes a hollow annular structure. The stirrer is made of a metal material. The cosmetic material can flow in the stirrer. The applicator assembly 30 can also be inserted into the stirrer, without affecting normal use of the cosmetic material. The stirrer made of the metal material such as stainless steel, copper, and aluminum does not affect the quality of the cosmetic material, achieves good stirring effect, and is not prone to damage.

Optionally, the stirrer includes an elastic member made of a metal material. While moving along the axial direction of the bottle assembly, the elastic member further causes deformations in a multidirectional manner. This further improves the stirring effect, and mixes the cosmetic material more uniformly.

Figure 7:
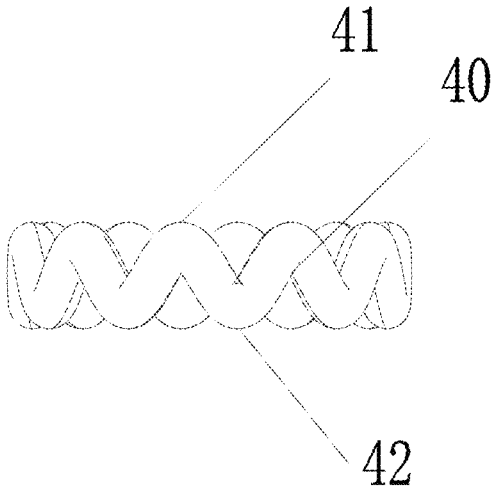
FIG. 7 is a first schematic structural view of a stirrer according to Embodiment 1 of the present disclosure.
Figure 8:
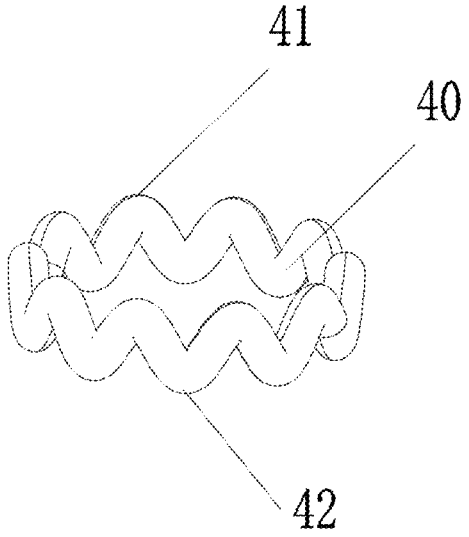
FIG. 8 is a second schematic structural view of a stirrer according to Embodiment 1 of the present disclosure.
Figure 9:
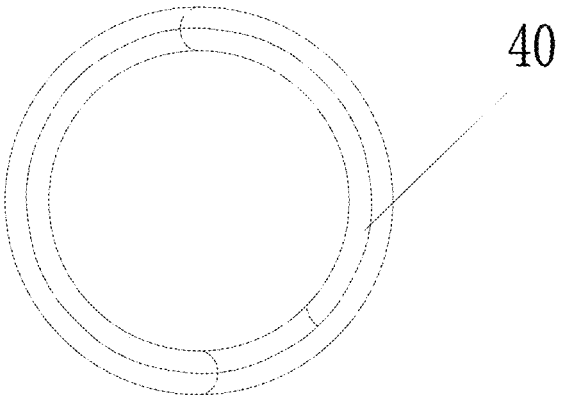
FIG. 9 is a third schematic structural view of a stirrer according to Embodiment 1 of the present disclosure.
Figure 10:
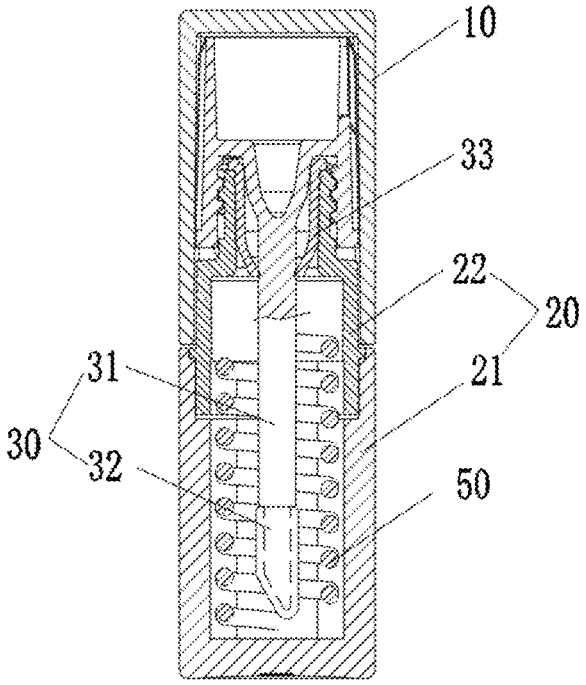
FIG. 10 is a schematic structural view of a cosmetic container according to Embodiment 2 of the present disclosure.
Figure 11:
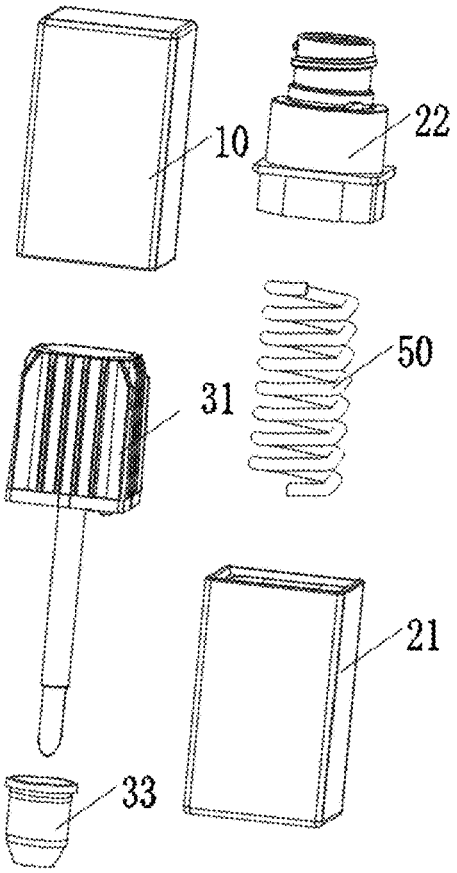
FIG. 11 is an exploded view of a cosmetic container according to Embodiment 2 of the present disclosure.
Figure 12:
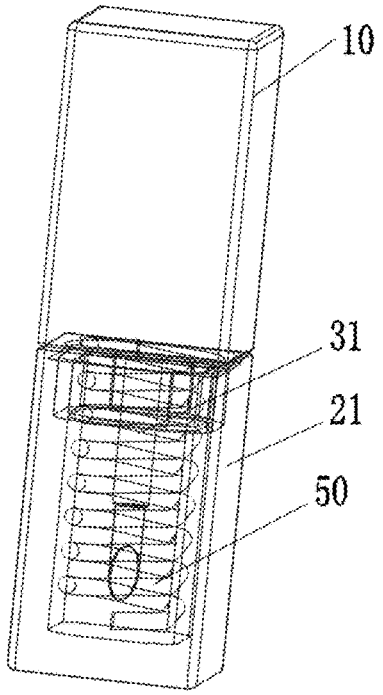
FIG. 12 is a perspective view of a cosmetic container according to Embodiment 2 of the present disclosure.
Figure 13:
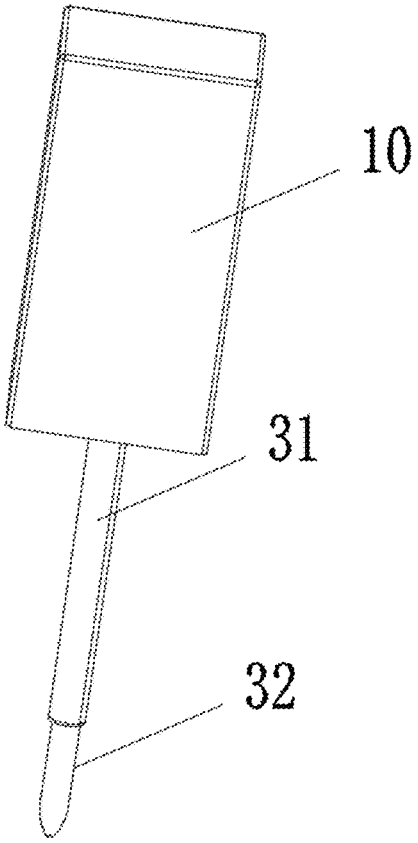
FIG. 13 is a schematic structural view of a lid assembly and an applicator assembly according to Embodiment 2 of the present disclosure.
Figure 14:
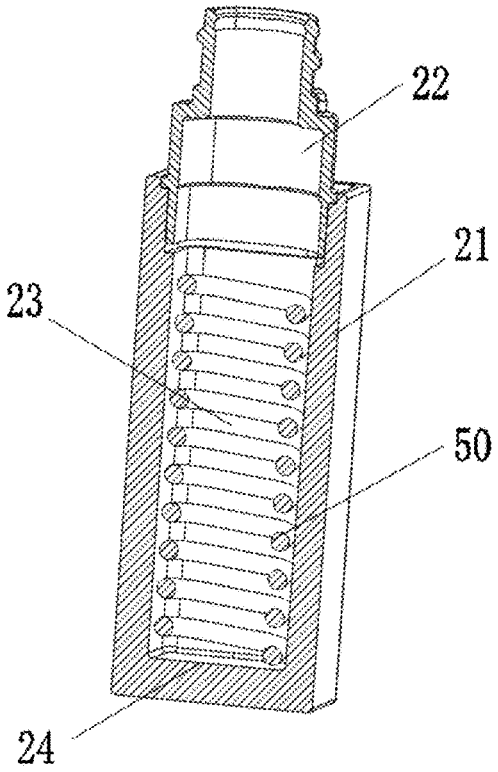
FIG. 14 is a first schematic structural view of a bottle assembly according to Embodiment 2 of the present disclosure.

As shown in FIGS. 7-9, the elastic member includes first spring 40 that is wavy. The first spring 40 encloses a sealed annular structure. In the embodiment, the first spring 40 that is elastic and wavy is used as the stirrer. A diameter of the first spring 40 is basically the same as an inner diameter of the bottle assembly. When the cosmetic container is shaken, the first spring 40 moves along the axial direction of the bottle assembly, and the first spring 40 can cause elastic deformations in a multidirectional manner. This fully stirs the cosmetic material in the bottle assembly, uniformly mixes the cosmetic material before use, and improves the makeup effect. Optionally, the first spring 40 is a circular ring. The diameter of the first spring 40 is greater than a height of the first spring 40. That is, the first spring 40 is a flat structure.

Figure 5:
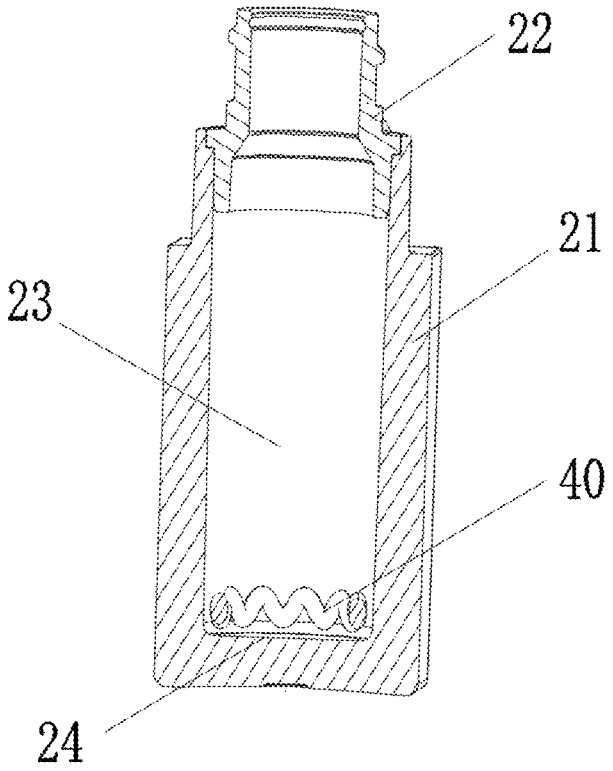
FIG. 5 is a first schematic structural view of a bottle assembly according to Embodiment 1 of the present disclosure.
Figure 6:
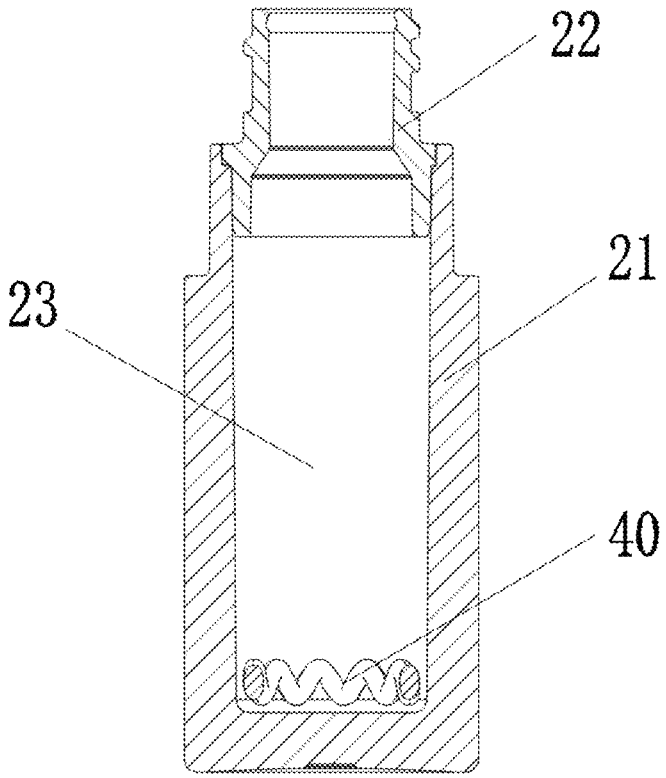
FIG. 6 is a second schematic structural view of a bottle assembly according to Embodiment 1 of the present disclosure.

The first spring 40 includes a plurality of waves, as shown in FIG. 1, FIG. 5 and FIG. 6. When the first spring 40 is provided in the bottle assembly 20, the waves extend along the axial direction of the bottle assembly 20. As shown in FIG. 7, the first spring 40 is axially provided with highest point 41 and lowest point 42 at intervals to form a wavy structure.

Figure 2:
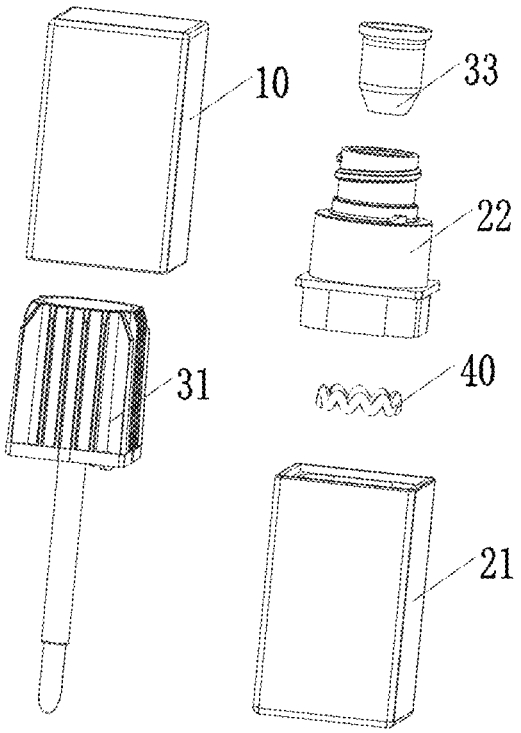
FIG. 2 is an exploded view of a cosmetic container according to Embodiment 1 of the present disclosure.
Figure 3:
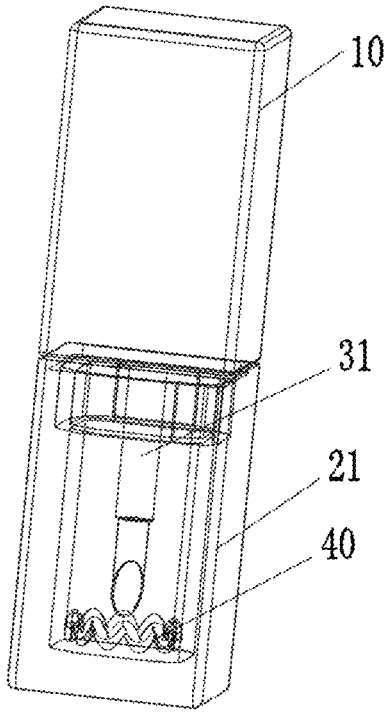
FIG. 3 is a perspective view of a cosmetic container according to Embodiment 1 of the present disclosure.
Figure 4:
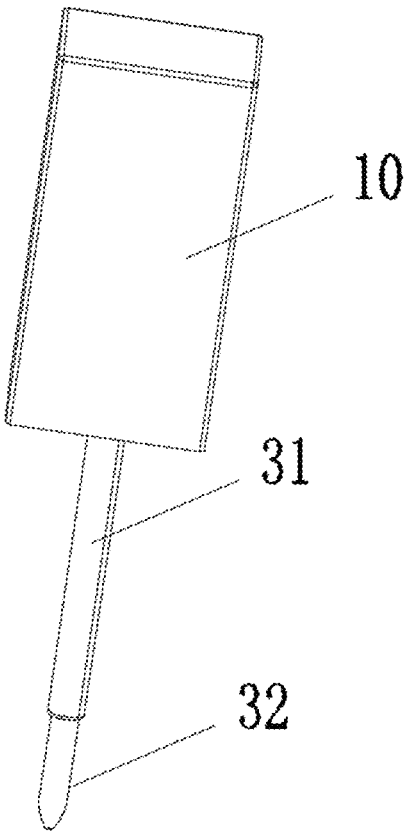
FIG. 4 is a schematic structural view of a lid assembly and an applicator assembly according to Embodiment 1 of the present disclosure.

As shown in FIG. 1, FIG. 2 and FIG. 5, the bottle assembly 20 includes bottle body 21 and intermediate ring 22 fixedly provided at a neck of the bottle body 21. The bottle body 21 includes the bottle bottom 24. The accommodation cavity 23 is formed in the bottle body 21. The applicator assembly 30 includes brush rod 31 and brush head 32 fixedly provided at a tail of the brush rod 31. A head of the brush rod 31 is fixedly provided in the lid assembly 10. The distance between the outer peripheral wall of the stirrer and the inner peripheral wall of the bottle assembly 20 is a distance between an outer peripheral wall of the elastic member and an inner peripheral wall of the bottle body 21. When the lid assembly 10 covers the bottle assembly 20, the brush rod 31 is threadedly connected to the intermediate ring 22. Internal stopper 33 is provided at an opening of the intermediate ring 22. The internal stopper 33 is configured to seal the intermediate ring 22. In makeup, the internal stopper 33 is further configured to scrape an excessive material on the brush rod 31 and the brush head 32. The brush head includes a bottom head, a flocking, a bristle, etc.

Before use of the cosmetic container, the container is shaken, such that the stirrer moves up and down in the bottle body 21 to mix the cosmetic material. Then, the lid assembly 10 is rotated, such that the lid assembly 10 is separated from the bottle assembly 20. At last, the cosmetic material is applied to a makeup portion with the brush head 32. The cosmetic container is particularly suitable for the cosmetic material to be mixed.

Embodiment 2

As shown in FIGS. 10-18, in the embodiment, the elastic member includes second spring 50. The second spring 50 moves up spirally along the axial direction of the bottle assembly 20.

Figure 15:
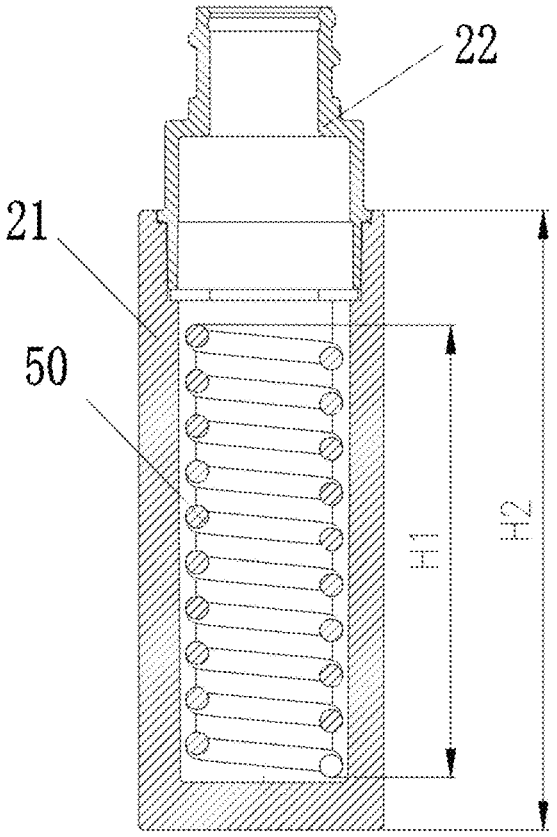
FIG. 15 is a second schematic structural view of a bottle assembly according to Embodiment 2 of the present disclosure.
Figure 16:
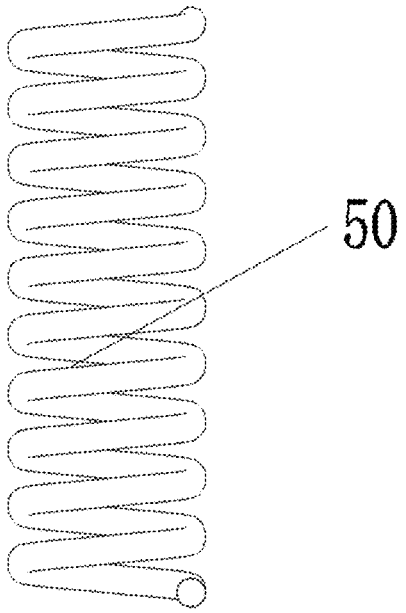
FIG. 16 is a first schematic structural view of a stirrer according to Embodiment 2 of the present disclosure.
Figure 17:
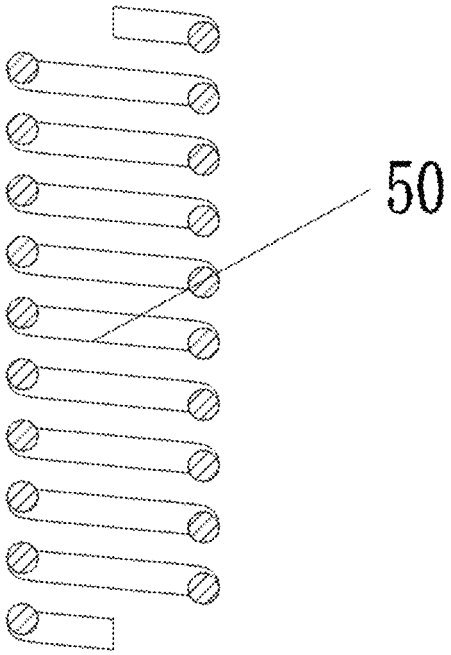
FIG. 17 is a second schematic structural view of a stirrer according to Embodiment 2 of the present disclosure.
Figure 18:
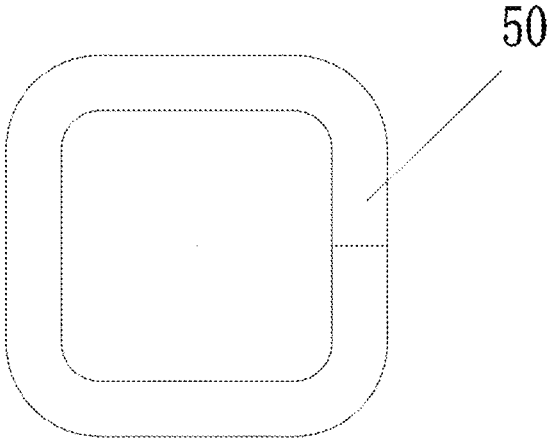
FIG. 18 is a third schematic structural view of a stirrer according to Embodiment 2 of the present disclosure.
Figure 19:
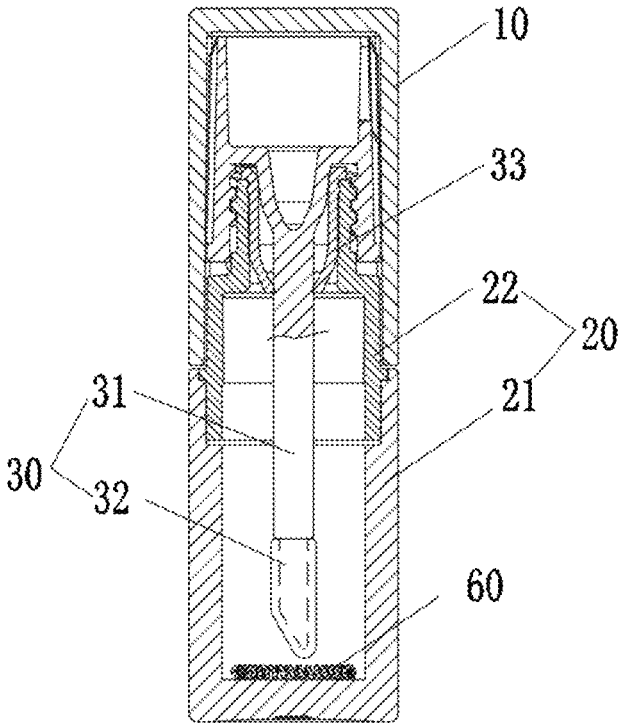
FIG. 19 is a schematic structural view of a cosmetic container according to Embodiment 3 of the present disclosure.
Figure 20:
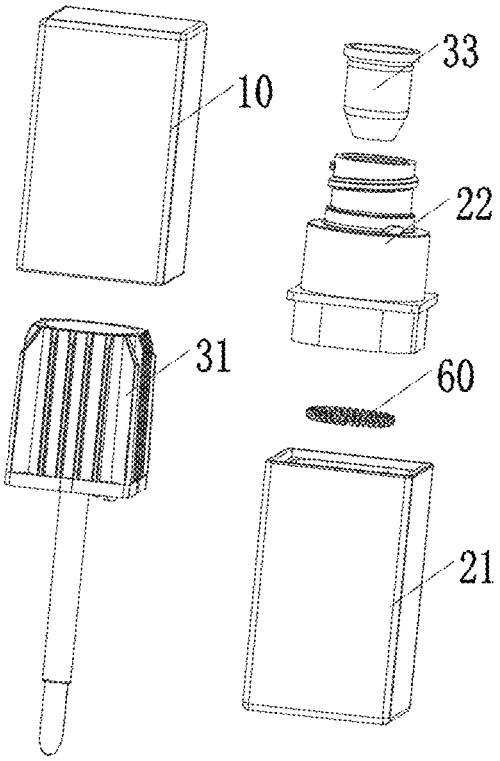
FIG. 20 is an exploded view of a cosmetic container according to Embodiment 3 of the present disclosure.
Figure 21:
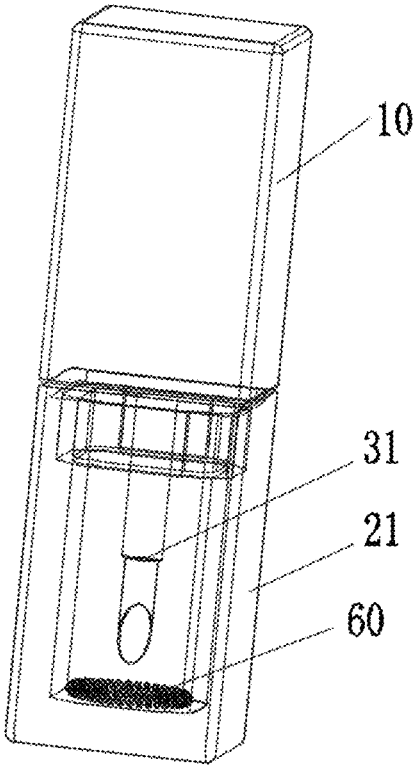
FIG. 21 is a perspective view of a cosmetic container according to Embodiment 3 of the present disclosure.
Figure 22:
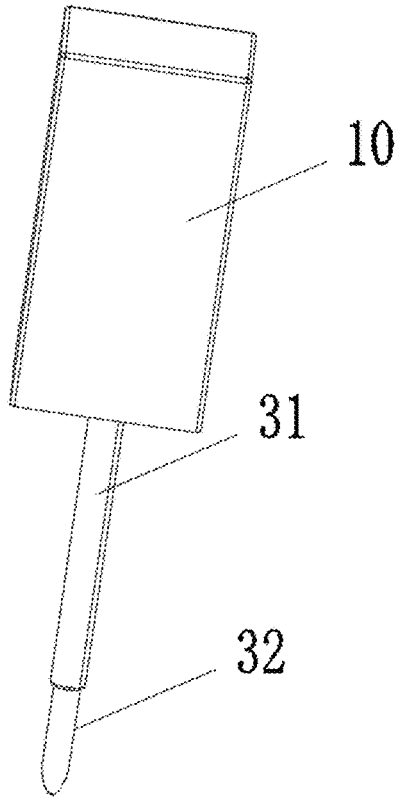
FIG. 22 is a schematic structural view of a lid assembly and an applicator assembly according to Embodiment 3 of the present disclosure.
Figure 23:
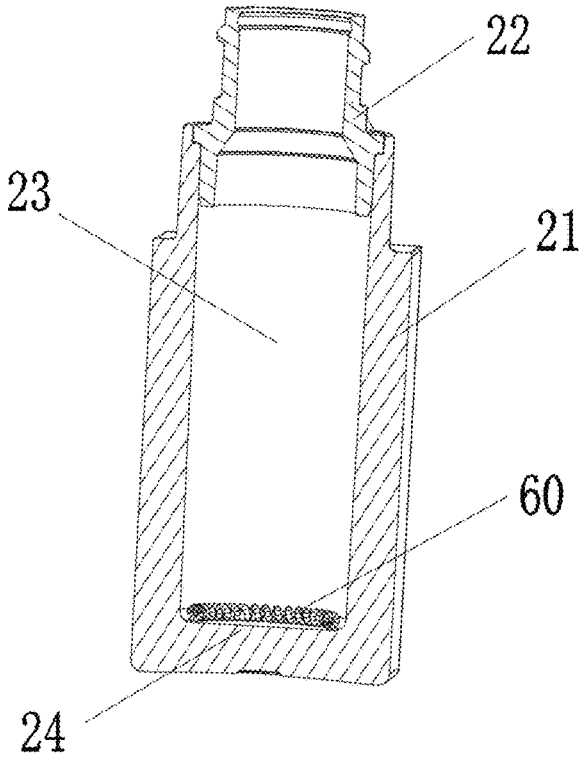
FIG. 23 is a first schematic structural view of a bottle assembly according to Embodiment 3 of the present disclosure.
Figure 24:
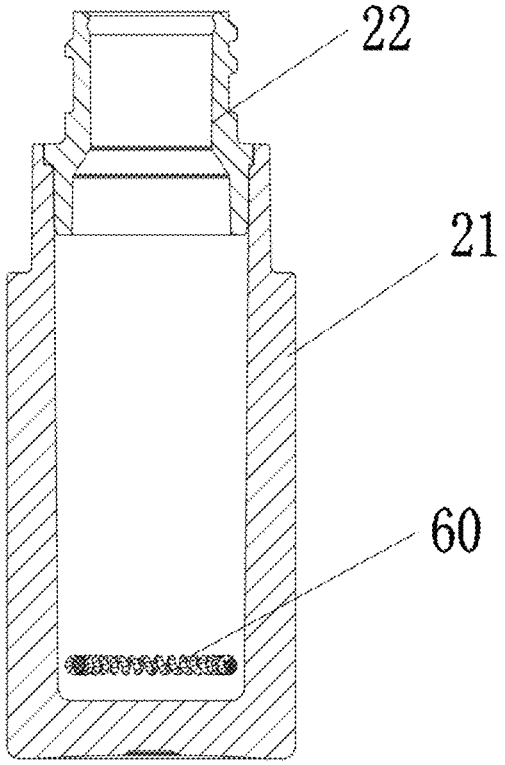
FIG. 24 is a second schematic structural view of a bottle assembly according to Embodiment 3 of the present disclosure.
Figure 25:
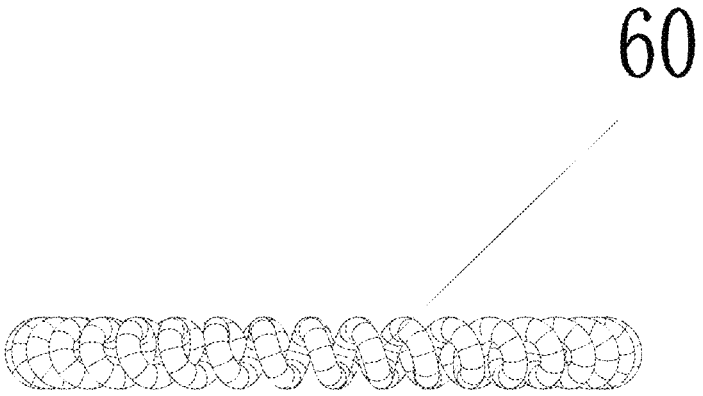
FIG. 25 is a first schematic structural view of a stirrer according to Embodiment 3 of the present disclosure.
Figure 26:
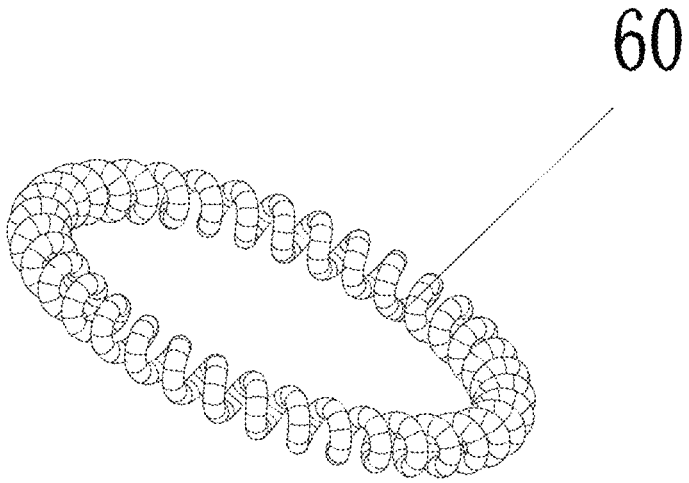
FIG. 26 is a second schematic structural view of a stirrer according to Embodiment 3 of the present disclosure.
Figure 27:
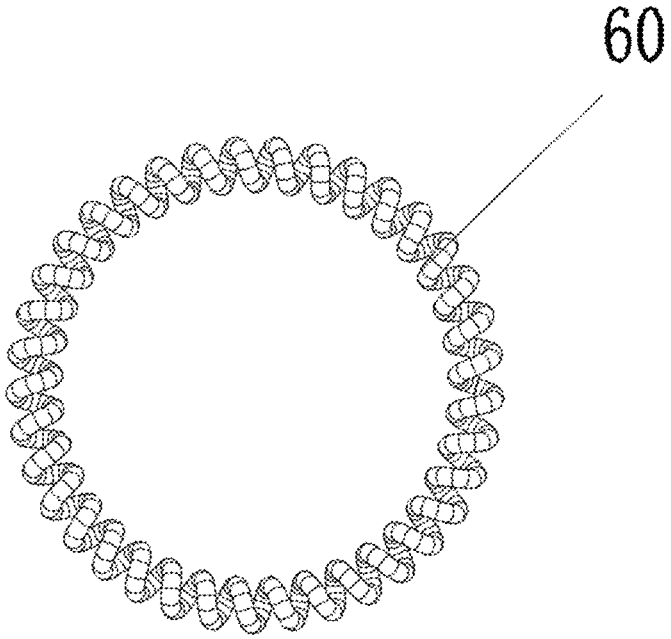
FIG. 27 is a third schematic structural view of a stirrer according to Embodiment 3 of the present disclosure.

As shown in FIG. 15, the second spring 50 has a height of H1, and the bottle assembly has a height of H2, H1≥0.7*H2. The height of the second spring 50 refers to the height of the second spring in a natural state. Optionally, the height of the second spring 50 is greater than a width of the second spring 50. In the embodiment, the elongated second spring 50 is used as the stirrer. When the cosmetic container is shaken, the second spring 50 retracts and extends repeatedly to stir the cosmetic material in the container. Optionally, as shown in FIG. 18, the second spring 50 is a square structure in a top view. The square second spring 50 is provided in the square accommodation cavity 23 of the bottle assembly to improve the stirring effect in the container.

Embodiment 3

As shown in FIGS. 19-27, in the embodiment, the elastic member includes third spring 60. The third spring 60 extends spirally along a circumferential direction of the bottle assembly 20. The third spring 60 encloses a sealed annular structure. Optionally, a height of the third spring 60 is less than a diameter of the third spring 60. That is, the third spring 60 is a flat structure. When the cosmetic container is shaken, the third spring 60 moves along the axial direction of the bottle assembly. The third spring 60 extending spirally along the circumferential direction has a high elastic deformation capacity, and stirs the cosmetic material through own deformations. This mixes the cosmetic material fully and uniformly before use to ensure the final makeup effect.

Embodiment 4

Figure 28:
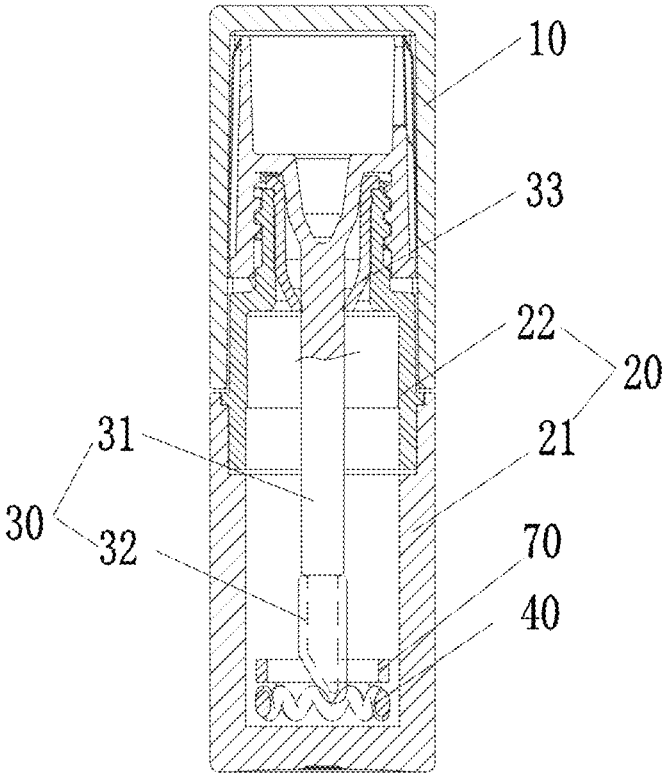
FIG. 28 is a schematic structural view of a cosmetic container according to Embodiment 4 of the present disclosure.

As shown in FIGS. 28-36, in the embodiment, the stirrer further includes weight 70. The weight 70 is a metal member of an annular structure. The weight 70 may be located at a side of the elastic member close to the bottle assembly 20, and may also be located at a side of the elastic member away from the bottle assembly 20. Optionally, as shown in FIG. 28, the weight 70 is located at a side of the elastic member away from the bottle bottom 24 of the bottle assembly 20. The elastic member and the weight are used as the stirrer. When the cosmetic container is shaken, the elastic member and the weight move along the axial direction of the bottle assembly 20. Meanwhile, the elastic member and the weight can collide with each other, compared with a case where the elastic member is individually used as the stirrer, the mixing effect of the cosmetic material is better.

Figure 29:
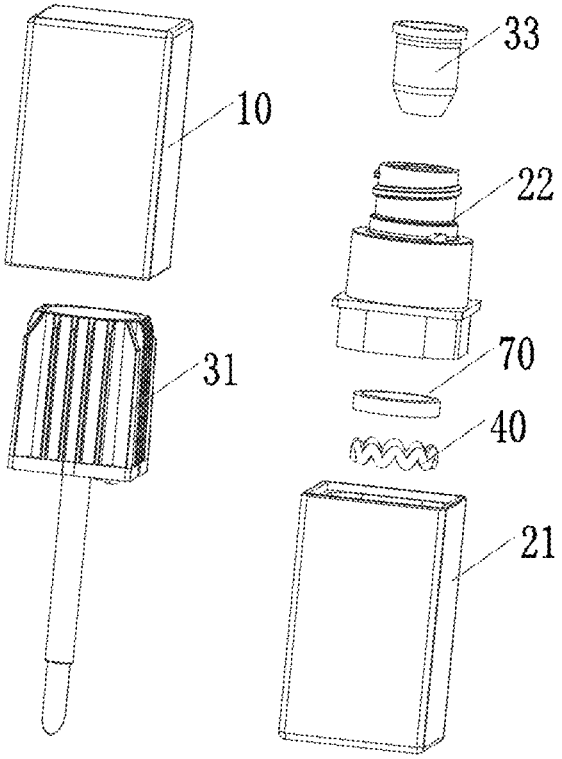
FIG. 29 is an exploded view of a cosmetic container according to Embodiment 4 of the present disclosure.
Figure 30:
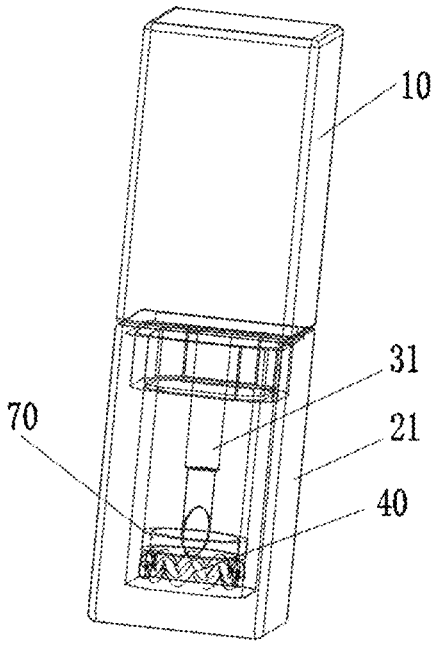
FIG. 30 is a perspective view of a cosmetic container according to Embodiment 4 of the present disclosure.
Figure 31:
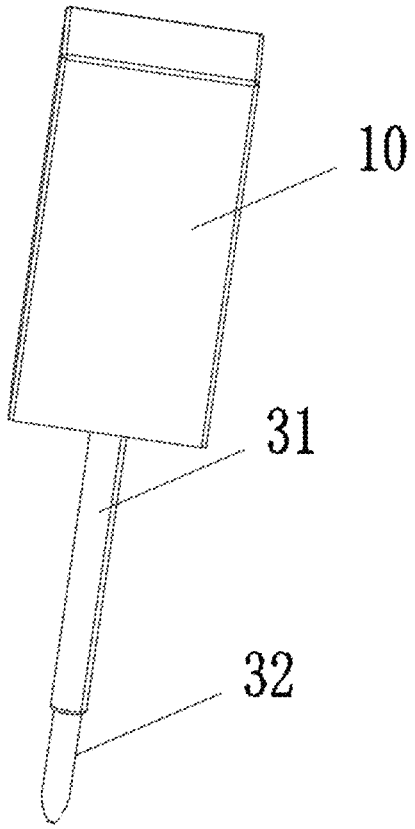
FIG. 31 is a schematic structural view of a lid assembly and an applicator assembly according to Embodiment 4 of the present disclosure.
Figure 32:
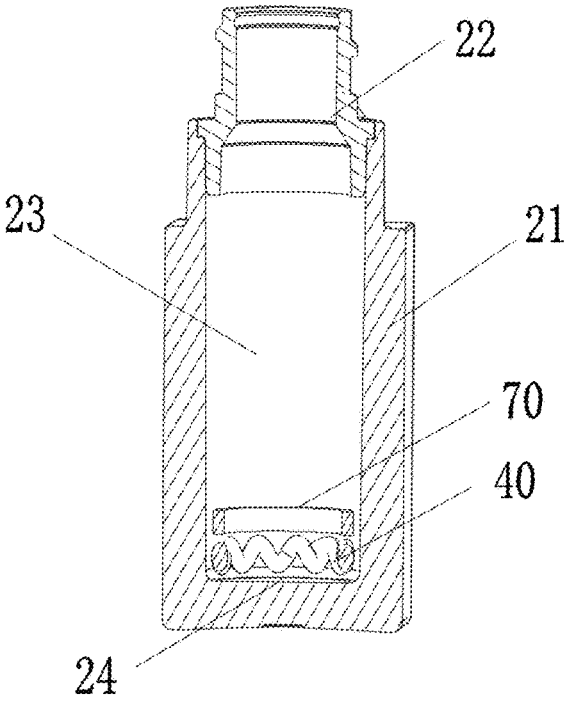
FIG. 32 is a first schematic structural view of a bottle assembly according to Embodiment 4 of the present disclosure.
Figure 33:
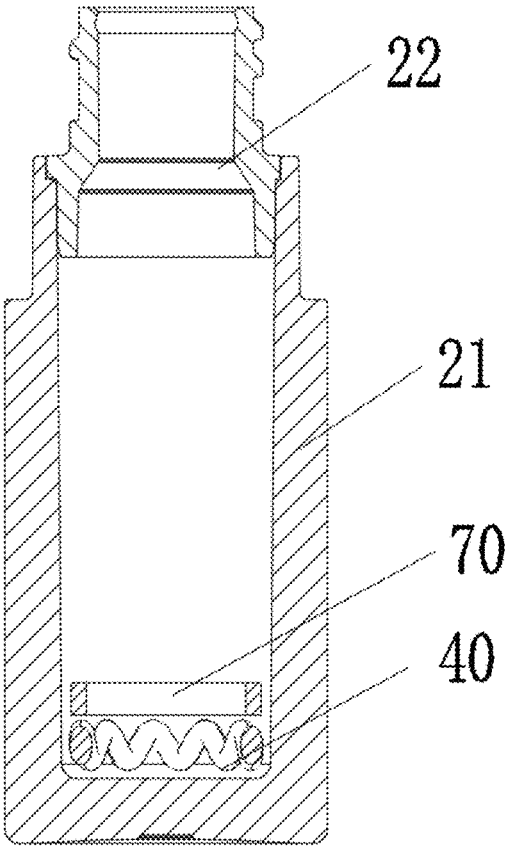
FIG. 33 is a second schematic structural view of a bottle assembly according to Embodiment 4 of the present disclosure.
Figure 34:
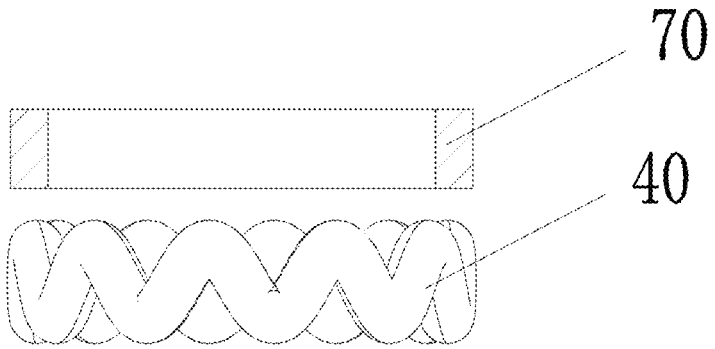
FIG. 34 is a first schematic structural view of a stirrer according to Embodiment 4 of the present disclosure.
Figure 35:
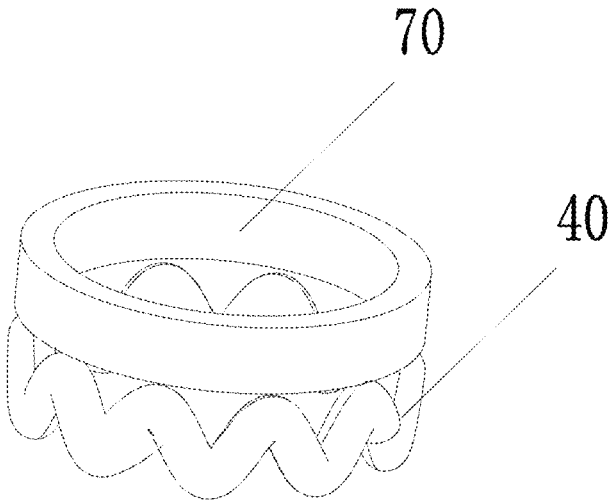
FIG. 35 is a second schematic structural view of a stirrer according to Embodiment 4 of the present disclosure.
Figure 36:
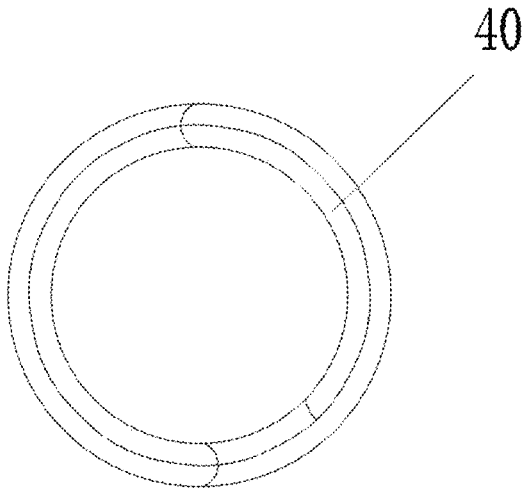
FIG. 36 is a third schematic structural view of a stirrer according to Embodiment 4 of the present disclosure.

In the embodiment, as shown in FIG. 28 and FIG. 29, the stirrer includes the first spring 40 and the weight 70. The weight 70 is located at a side of the first spring 40 away from the bottle bottom of the bottle assembly 20. That is, the weight 70 is located on the first spring 40. When the cosmetic container is shaken, the first spring 40 and the weight 70 move along the axial direction of the bottle assembly 20. Meanwhile, the first spring 40 and the weight 70 can collide with each other to improve the mixing effect of the cosmetic material. The first spring 40 is the wavy structure. The weight 70 and the first spring 40 contact through spaced points and do not contact completely, so the weight and the first spring are not adhered together easily to affect the stirring effect of the stirrer.

Orthographic projection of the elastic member on the bottle bottom 24 of the bottle assembly 20 is at least one of a square, an ellipse, and a circle. Orthographic projection of the weight 70 on the bottle bottom 24 of the bottle assembly 20 is at least one of a square, an ellipse, and a circle. The square may be a quadrate, a rectangle or other polygons. The elastic member and the weight 70 may have different shapes according to an actual need, thereby adapting for various shapes of the cosmetic container. Optionally, orthographic projection of the elastic member on the bottle bottom 24 and orthographic projection of the weight on the bottle bottom 24 are the same.

In other embodiments, the stirrer includes the second spring 50 and the weight 70, or the stirrer includes the third spring 60 and the weight 70. The mounting manner and the working principle are the same as those in Embodiment 4, and are not repeated herein.

It should be noted that a person of ordinary skill in the art can further make various variations and improvements without departing from the conception of the present disclosure. These variations and improvements all fall within the protection scope of the present disclosure. Therefore, the protection scope of the present disclosure shall be subject to the appended claims.

What is claimed is:

1. A convenient-to-stir cosmetic container, comprising a lid assembly, a bottle assembly, an applicator assembly, and a stirrer, wherein the applicator assembly is provided in the lid assembly; the lid assembly is allowed for covering the bottle assembly; the bottle assembly is provided therein with an accommodation cavity for storing a cosmetic material; the stirrer is provided in the accommodation cavity; the stirrer is allowed for moving along an axial direction of the bottle assembly to stir the cosmetic material in the accommodation cavity; and a distance between an outer peripheral wall of the stirrer and an inner peripheral wall of the bottle assembly is L1, and the accommodation cavity has a width of L2, L1≤0.1*L, wherein the stirrer comprises an elastic member made of a metal material, and wherein the elastic member comprises a first spring that is wavy, and the first spring encloses a sealed annular structure.

2. The convenient-to-stir cosmetic container according to claim 1, wherein the outer peripheral wall of the stirrer contacts the inner peripheral wall of the bottle assembly.

3. The convenient-to-stir cosmetic container according to claim 2, wherein a shape enclosed by the outer peripheral wall of the stirrer is the same as a shape enclosed by the inner peripheral wall of the bottle assembly.

4. The convenient-to-stir cosmetic container according to claim 1, wherein the first spring comprises a plurality of waves; and when the first spring is provided in the bottle assembly, the plurality of waves extend along the axial direction of the bottle assembly.

5. The convenient-to-stir cosmetic container according to claim 4, wherein the stirrer further comprises a weight; the weight is a metal member of an annular structure; and the weight is located at a side of the elastic member away from a bottle bottom of the bottle assembly.

6. The convenient-to-stir cosmetic container according to claim 5, wherein orthographic projection of the elastic member on the bottle bottom of the bottle assembly is at least one of a square, an ellipse, and a circle; and orthographic projection of the weight on the bottle bottom of the bottle assembly is at least one of a square, an ellipse, and a circle.

7. The convenient-to-stir cosmetic container according to claim 1, wherein the stirrer further comprises a weight; the weight is a metal member of an annular structure; and the weight is located at a side of the elastic member away from a bottle bottom of the bottle assembly.

8. The convenient-to-stir cosmetic container according to claim 7, wherein orthographic projection of the elastic member on the bottle bottom of the bottle assembly is at least one of a square, an ellipse, and a circle; and orthographic projection of the weight on the bottle bottom of the bottle assembly is at least one of a square, an ellipse, and a circle.

9. The convenient-to-stir cosmetic container according to claim 7, wherein the bottle assembly comprises a bottle body and an intermediate ring fixedly provided at a neck of the bottle body; the bottle body comprises the bottle bottom; the accommodation cavity is formed in the bottle body; the applicator assembly comprises a brush rod and a brush head fixedly provided at a tail of the brush rod; and a head of the brush rod is fixedly provided in the lid assembly.

* * * * *